US010150208B2

(12) United States Patent
Lin

(10) Patent No.: US 10,150,208 B2
(45) Date of Patent: Dec. 11, 2018

(54) MUZZLE SUITABLE FOR HOLDING NAIL CLAMPS

(71) Applicant: NAILERMATE ENTERPRISE CORPORATION, Taichung (TW)

(72) Inventor: Wen-Pin Lin, Taichung (TW)

(73) Assignee: Nailermate Enterprise Corporation, Taichung (TW)

( * ) Notice: Subject to any disclaimer, the term of this patent is extended or adjusted under 35 U.S.C. 154(b) by 556 days.

(21) Appl. No.: 14/874,327

(22) Filed: Oct. 2, 2015

(65) Prior Publication Data

US 2017/0095916 A1 Apr. 6, 2017

(51) Int. Cl.

| | |
|---|---|
| ***B25C 1/00*** | (2006.01) |
| ***B25C 5/16*** | (2006.01) |
| ***B25C 1/18*** | (2006.01) |

(52) U.S. Cl.

CPC ..... *B25C 5/1658* (2013.01); *B25C 1/184* (2013.01)

(58) Field of Classification Search

CPC B25C 1/00; B25C 1/001; B25C 1/184; B25B 31/00

USPC ..... 227/109; 292/256

See application file for complete search history.

(56) References Cited

U.S. PATENT DOCUMENTS

| | | | | |
|---|---|---|---|---|
| 3,391,842 | A * | 7/1968 | Mathes | B25C 1/02 227/147 |
| 4,424,929 | A * | 1/1984 | Weis | B25B 31/00 227/113 |
| 4,537,343 | A * | 8/1985 | Johansson | B25B 31/00 227/120 |
| 4,709,842 | A * | 12/1987 | Westerlund | B25B 31/00 227/109 |
| 5,014,897 | A * | 5/1991 | Uuskallio | B25C 7/00 227/119 |
| 2008/0179371 | A1* | 7/2008 | Gardner | B25C 5/15 227/1 |
| 2014/0197222 | A1* | 7/2014 | Howe | H02G 3/32 227/109 |

* cited by examiner

*Primary Examiner* — Andrew M Tecco
*Assistant Examiner* — Chelsea Stinson
(74) *Attorney, Agent, or Firm* — Wang Law Firm, Inc.

(57) ABSTRACT

A muzzle suitable for holding different sized nail clamps includes a restricting plate and a movable member. The movable member is coupled to the cover and movable in the restricting direction. The restricting plate is inserted in the nail-hitting track and movable in the restricting direction. Therefore, the restricting plate can be moved to press against the second lateral side of different sized nail clamps to clamp the nail clamp between the lateral surface of the nail-hitting track and the restricting plate, and the nail clamp can be firmly positioned in the nail-hitting track without slipping.

5 Claims, 11 Drawing Sheets

MUZZLE SUITABLE FOR HOLDING NAIL CLAMPS

BACKGROUND OF THE INVENTION

Field of the Invention

The present invention relates to a nail gun, and more particularly to a muzzle suitable for holding nail clamps.

Related Prior Art

Nail guns are commonly used in the current industry and generally categorized into pneumatic nail gun and electric nail gun based on the type of power used to drive the nail guns. A nail gun essentially includes a nail gun body and a magazine which is used to store nails. At one end of the magazine is disposed a muzzle which is suitable for holding nail clamps. The nail gun has a piston rod inserted into the head portion of the magazine to hit the nail loaded in the muzzle.

Another type of nail clamp commercially available on the market is used to fix cylindrical objects, such as wires, cables or pipes. The user has to manually hammer the nail clamps one by one into the surface, which is very troublesome and inconvenient. We need a muzzle which is suitable for holding nail clamps, so that the nail clamps can be fired with nail guns to improve work efficiency.

Therefore, a nail gun and a muzzle thereof which are suitable for holding nail clamps have been developed. The muzzle has a nail feeding hole coupled to the magazine, nail clamps are fed from the magazine into a nail hitting groove of the muzzle via the nail feeding hole, and then wait to be hit by a piston. However, the width of the nail hitting groove of the muzzle is usually not adjustable, and the muzzle is only capable of holding specific sized nail clamps. When the nail clamps are shorter than the width of the nail hitting groove, they cannot be held firmly in the muzzle, which might adversely affect the firing performance.

The present invention has arisen to mitigate and/or obviate the afore-described disadvantages.

SUMMARY

The present invention is aimed at providing a muzzle suitable for holding different sized nail clamps.

To achieve the above objective, a muzzle suitable for holding nail clamps being coupled to a magazine and a nail gun body, the muzzle is disposed at a nail discharging end of the magazine, the magazine includes a chamber for holding the nail clamps, the nail gun body has a piston inserted into the muzzle, the muzzle comprises:

a nail-discharging member coupled to the nail discharging end of the magazine, and including a nail-hitting track and a nail-feeding hole which are in communication with each other, the nail-feeding hole being formed to conform to the shape of the nail clamps, and located corresponding to the nail discharging end of the magazine, and in communication with the chamber, the nail clamps in the chamber move into the nail-hitting track through the nail-feeding hole, a piston hole and a nail-discharging passage being formed at two ends of the nail-hitting track, respectively, the piston hole being located toward the nail gun body, wherein the piston of the nail gun body is inserted through the piston hole into the nail-hitting track, the nail-discharging passage allows the nail clamps to move out of the nail-discharging member, when the piston inserts into the nail-hitting track to hit the nail clamps located in the nail-hitting track, the nail clamps will be pushed through the nail-discharging passage;

a cover including a pivoting end and a movable end, a direction extending from the pivoting end to the movable end being defined as a nail-hitting direction, the pivoting end being pivotally connected to one end of the nail-discharging member where the piston hole is located, so that the cover is able to rotate with respect to the nail-discharging member by pivoting about the pivoting end, the cover including a penetrating hole which extends in a restricting direction; and a restricting assembly including an inserting member and a restricting plate which are coupled to each other, the inserting member being inserted in the restricting direction and inserted into the penetrating hole, the restricting plate being fixed at one end of the inserting member and inserted into the nail-hitting track, wherein each of the nail clamps has a first lateral side and an opposite second lateral side, the first lateral side is abutted against a lateral surface of the nail-hitting track, and the restricting plate presses against the second lateral side.

The muzzle of the present invention essentially includes the restricting plate and the movable member. The movable member is coupled to the cover and movable in the restricting direction. The restricting plate is inserted in the nail-hitting track and movable in the restricting direction. Therefore, the restricting plate can be moved to press against the second lateral side of different sized nail clamps to clamp the nail clamp between the lateral surface of the nail-hitting track and the restricting plate, and the nail clamp can be firmly positioned in the nail-hitting track without slipping.

DETAILED DESCRIPTION

Figure 1:
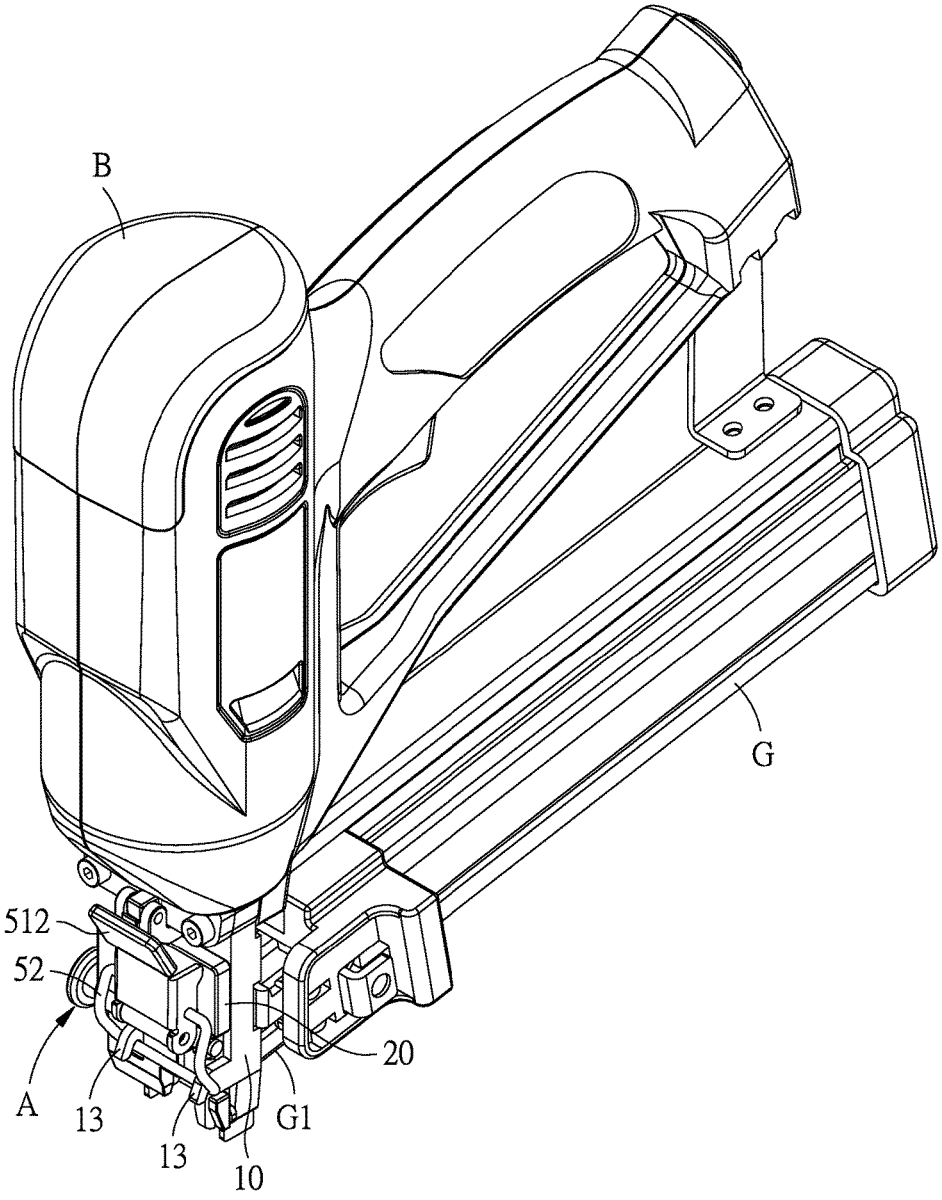
FIG. 1 is a perspective view of a muzzle suitable for holding nail clamps in accordance with a preferred embodiment of the present invention.
Figure 2:
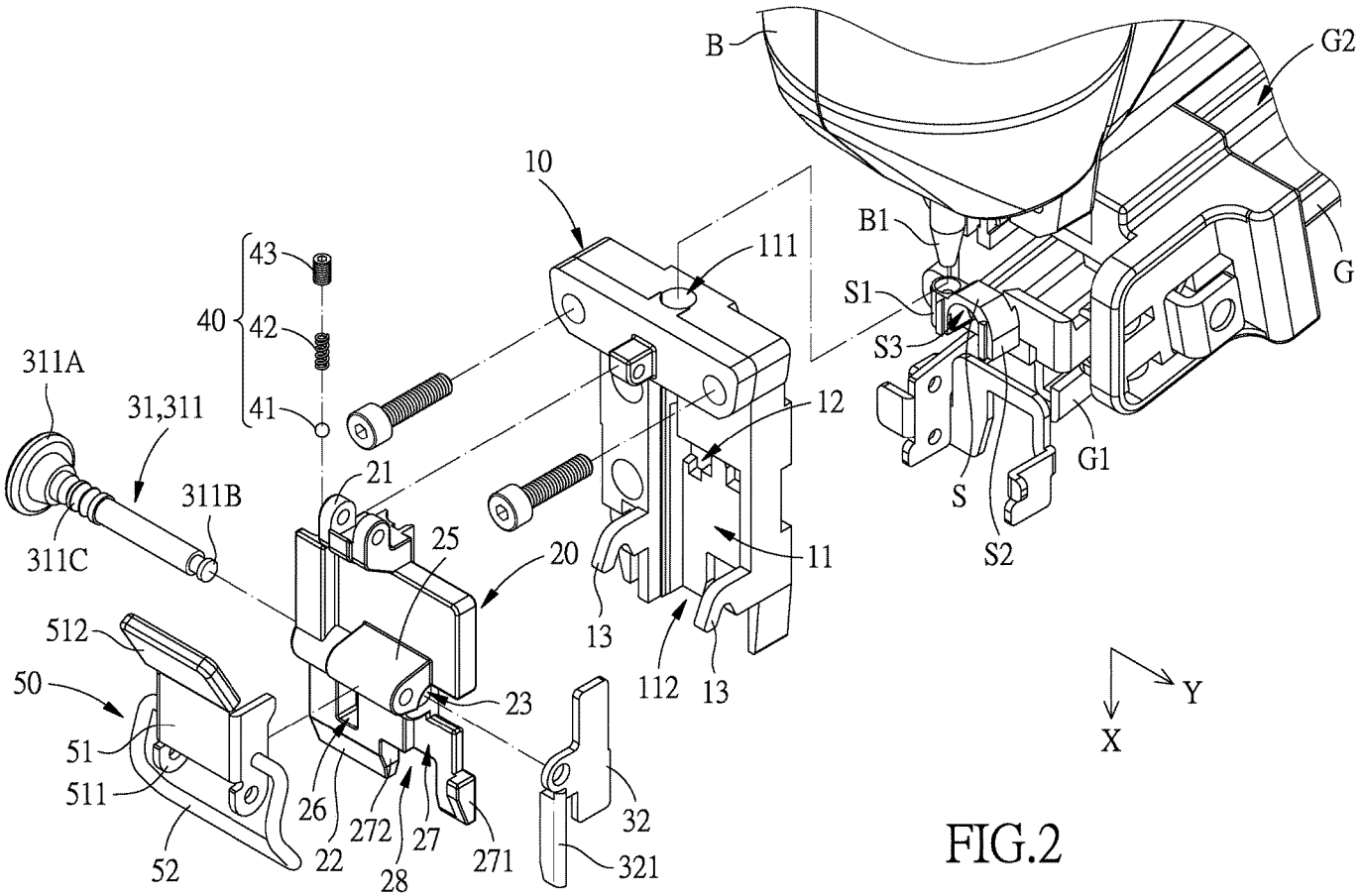
FIG. 2 is an exploded view of the muzzle suitable for holding nail clamps in accordance with the first preferred embodiment of the present invention.
Figure 3:
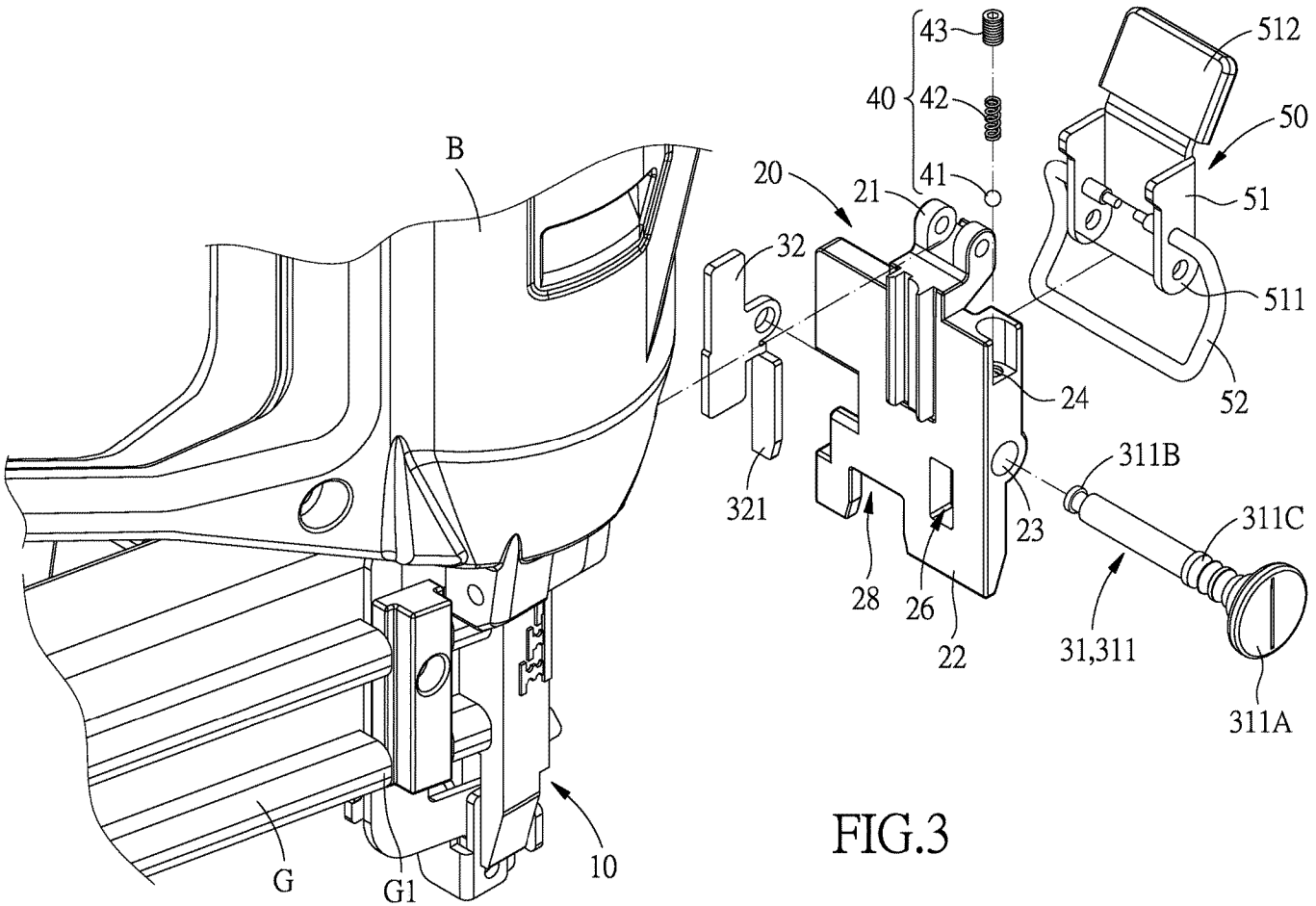
FIG. 3 is another exploded view of the muzzle suitable for holding nail clamps in accordance with the first preferred embodiment of the present invention.
Figure 4:
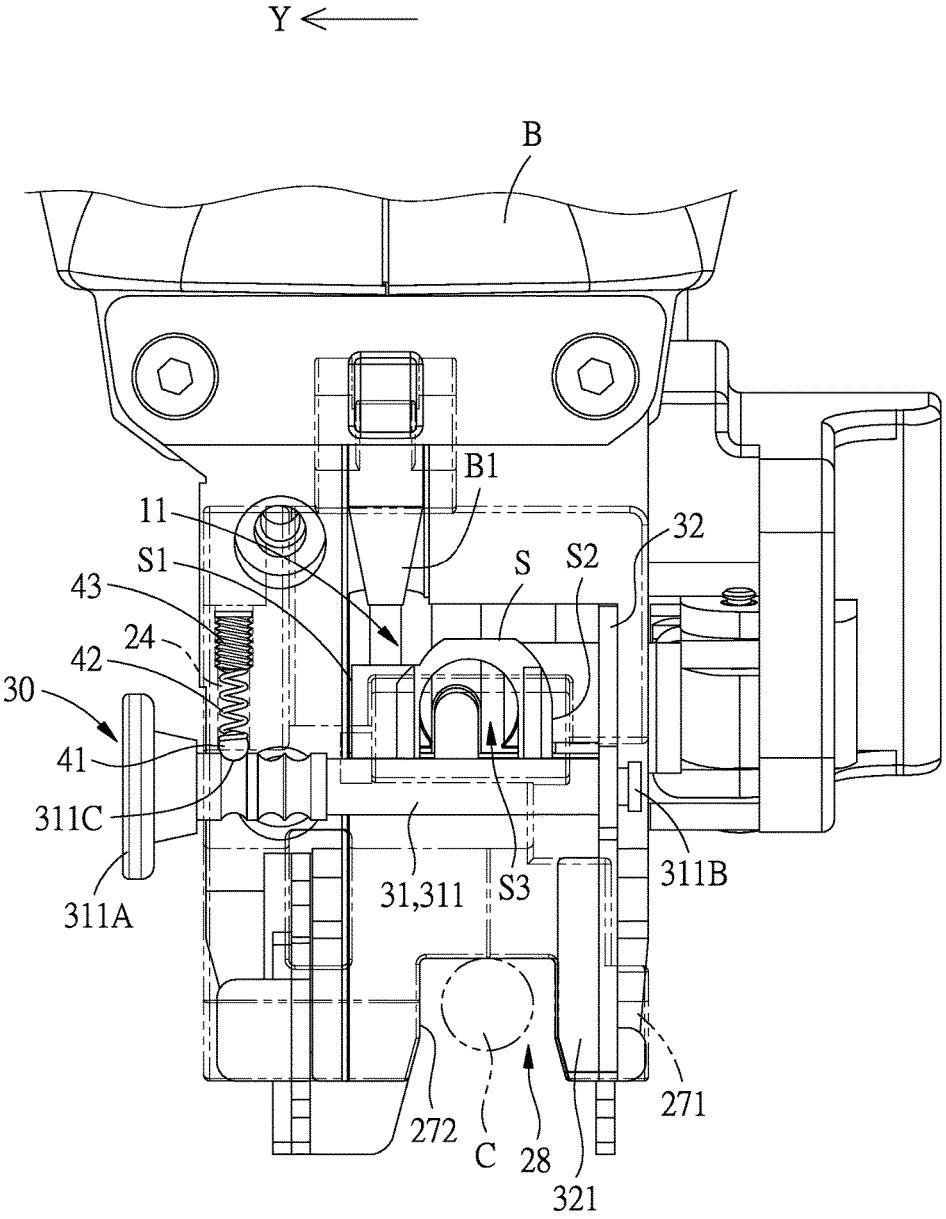
FIG. 4 is a front view of the muzzle suitable for holding nail clamps in accordance with the first preferred embodiment of the present invention.
Figure 5:
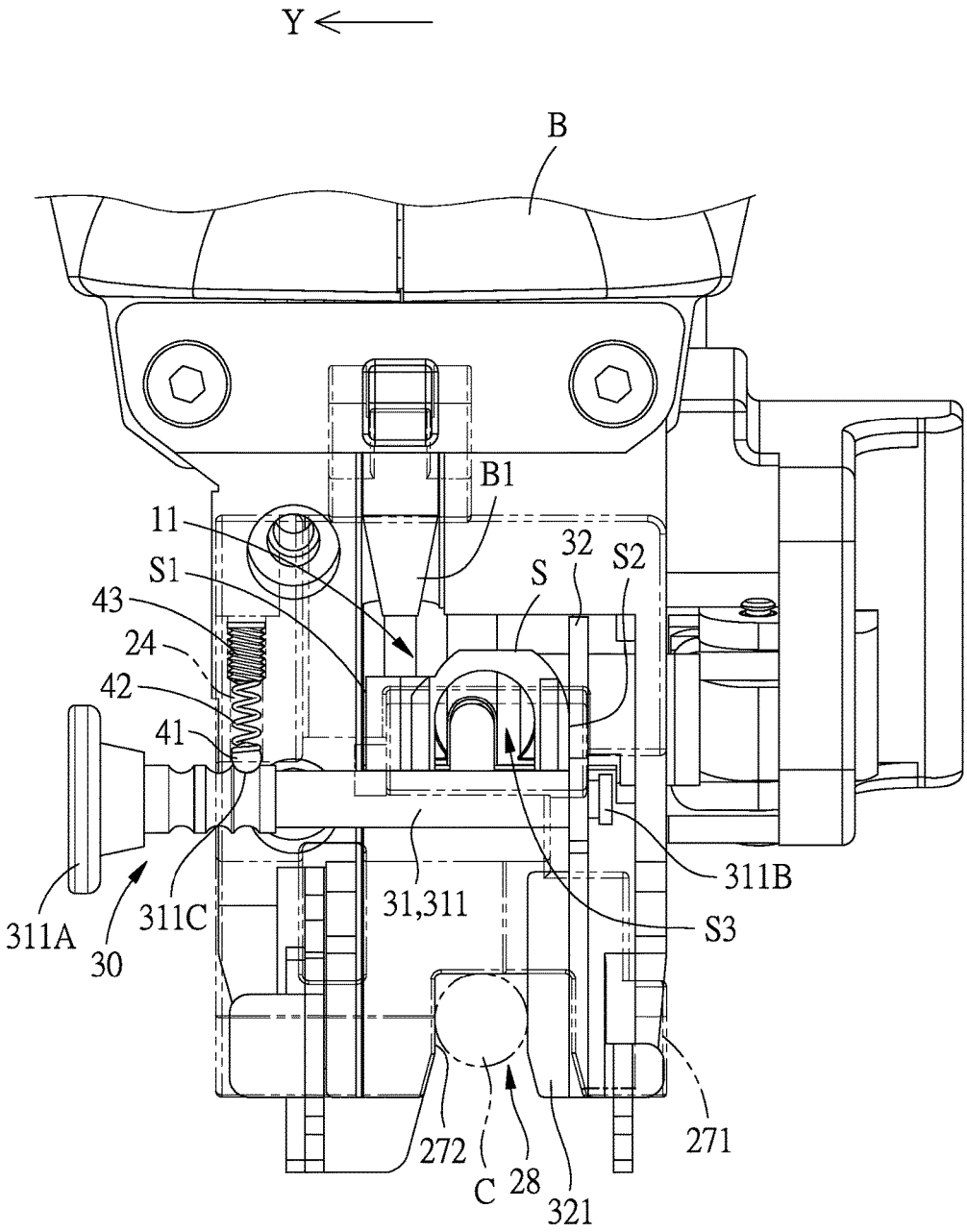
FIG. 5 is a front view of the muzzle suitable for holding nail clamps in accordance with the first preferred embodiment of the present invention.
Figure 6:
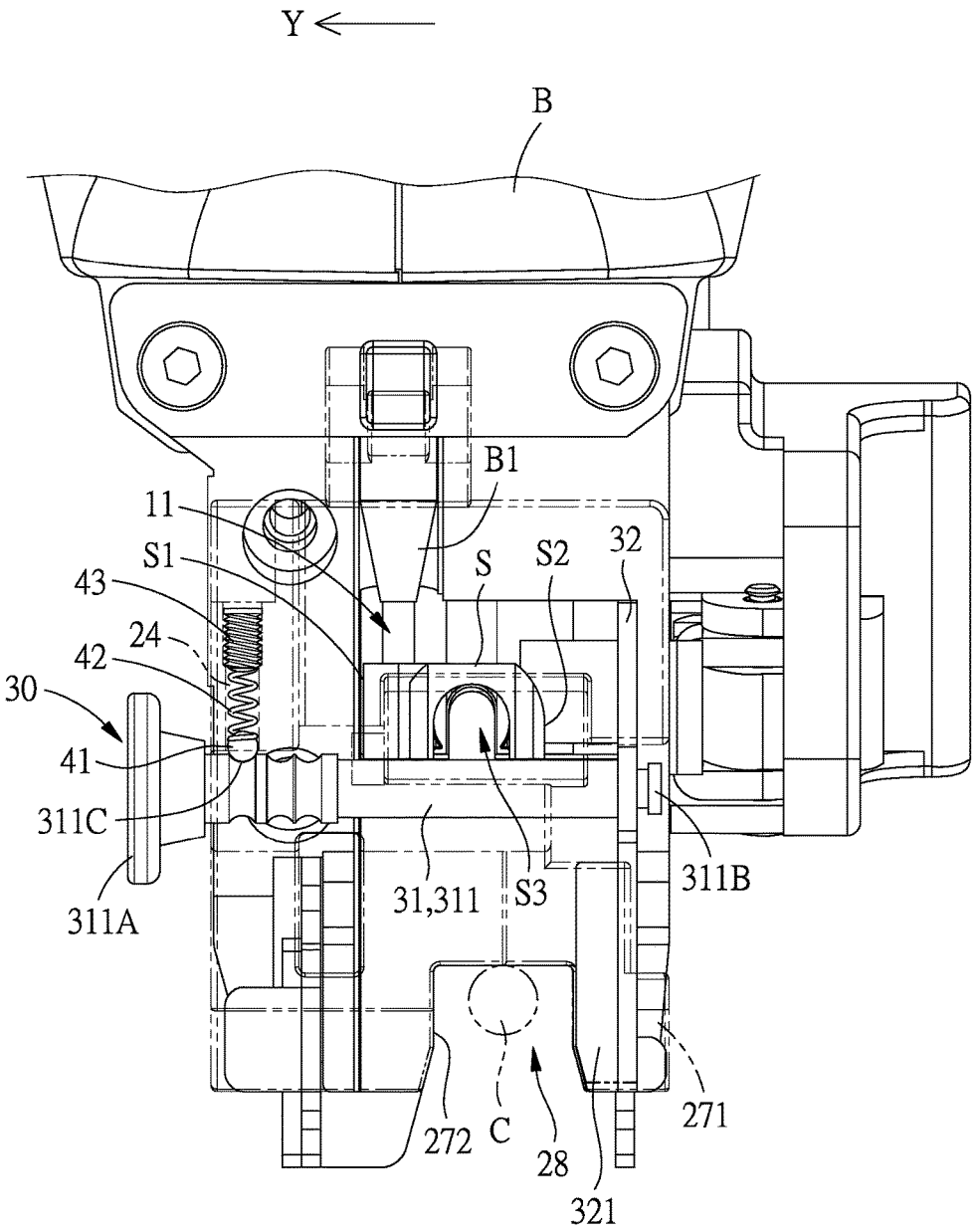
FIG. 6 is a front view of the muzzle suitable for holding nail clamps in accordance with the first preferred embodiment of the present invention.
Figure 7:
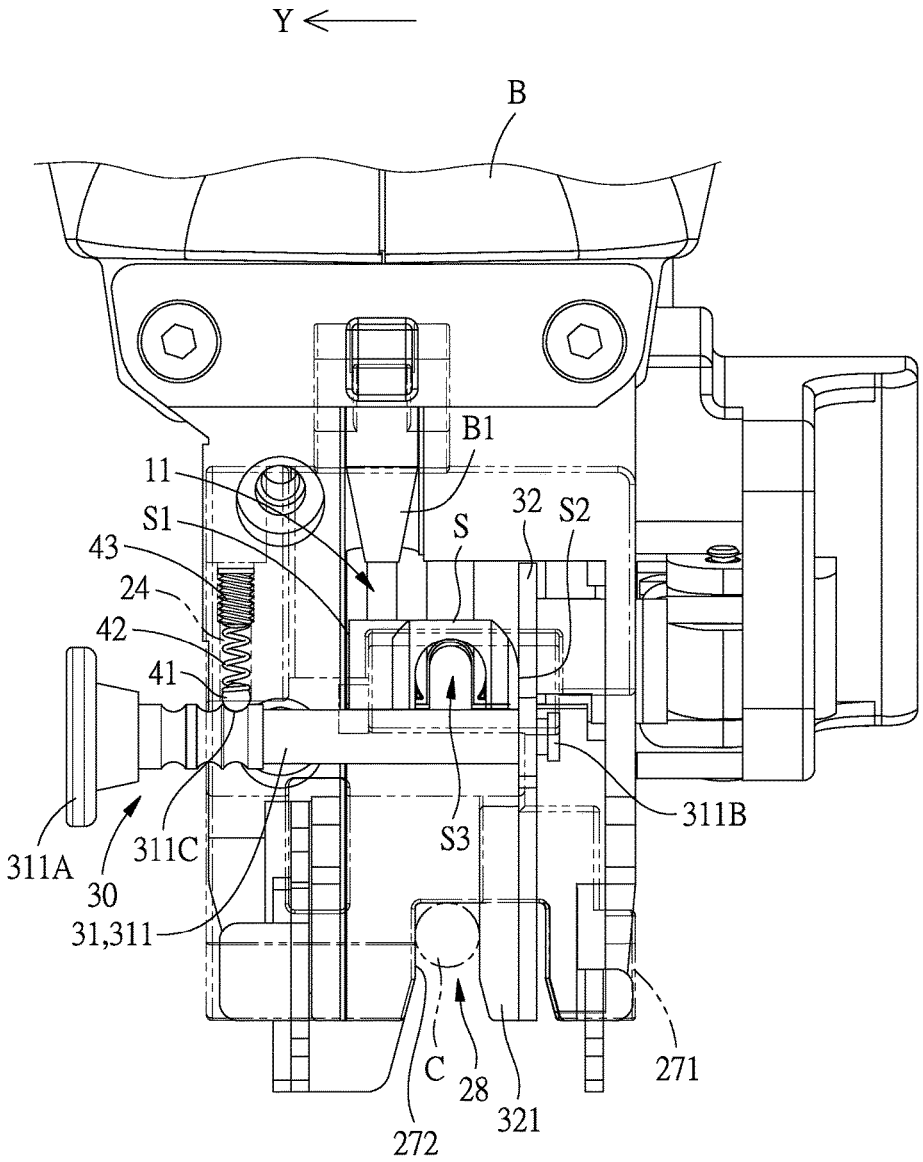
FIG. 7 is another front view of the muzzle suitable for holding nail clamps in accordance with the first preferred embodiment of the present invention.

The present invention will be clearer from the following description when viewed together with the accompanying drawings, which show, for purpose of illustrations only, the preferred embodiment in accordance with the present invention.

Referring to FIGS. 1-11, a muzzle A suitable for holding nail clamps in accordance with a preferred embodiment of the present invention is coupled to a magazine G and a nail gun body B. The muzzle A is disposed at a nail discharging end G1 of the magazine G. The magazine G includes a chamber G2 for holding the nail clamps S. The nail gun body B has a piston B1 inserted into the muzzle A. The muzzle A comprises a nail-discharging member 10, a cover 20, a restricting assembly 30, and a cover opening and closing member 50.

The nail-discharging member 10 is coupled to the nail discharging end G1 of the magazine G, and includes a nail-hitting track 11 and a nail-feeding hole 12 which are in communication with each other. The nail-feeding hole 12 is formed to conform to the shape of the nail clamps S, located corresponding to the nail discharging end G1 of the magazine G, and in communication with the chamber G2. The nail clamps S in the chamber G2 move into the nail-hitting track 11 through the nail-feeding hole 12. At one end of the nail-hitting track 11 is formed a piston hole 111, and at another end of the nail-hitting track 11 is a nail-discharging passage 112. The piston hole 111 is located toward the nail gun body B, and the piston B1 of the nail gun body B is inserted through the piston hole 111 into the nail-hitting track 11. The nail-discharging passage 112 allows the nail clamp S to move out of the nail-discharging member 10. When the piston B1 is inserted into the nail-hitting track 11 to hit the nail clamp S which is located in the nail-hitting track 11, the nail clamp S will be pushed through the nail-discharging passage 112, and thus the nail clamp S is fired. The nail-discharging member 10 is formed with two spaced apart hooks 13.

The cover 20 is used to prevent disengagement of the nail clamp S from the nail-hitting track 11, and includes a pivoting end 21 and a movable end 22. A direction extending from the pivoting end 21 to the movable end 22 is defined as a nail-hitting direction X. The pivoting end 21 is pivotally connected to the one end of the nail-discharging member 10 where the piston hole 111 is located, so that the cover 20 is able to rotate with respect to the nail-discharging member 10 by pivoting about the pivoting end 21. When it covers the nail-discharging member 10, the cover 20 has a first surface facing the nail-discharging member 10. The pivoting of the cover 20 with respect to the nail-discharging member 10 makes it easy for the user to observe the nail clamps S inside the nail-discharging member 10 and remove the jammed nail clamp(s) S. The cover 20 has a penetrating hole 23 which extends in a restricting direction Y which is perpendicular to the nail-hitting direction X. A second surface of the cover 20 opposite to the first surface facing the nail-discharging member 10 is formed with a connecting portion 25. The cover 20 has a hook hole 26 for insertion of the hooks 13. At the movable end 22 of the cover 20 is further formed a restricting notch 28 for holding a wire C, as shown in FIGS. 4-7, so as to prevent undesired displacement of the wire C when the nail gun is in use. On the second surface of the cover 20 where the connecting portion 25 is located is formed a concave 27 which is in communication with the restricting notch 28. The concave 27 includes a restricting wall 271 and an opposite clamping wall 272.

The restricting assembly 30 includes an inserting member 31 and a restricting plate 32 which are coupled to each other. The inserting member 31 is inserted in the restricting direction Y and inserted into the penetrating hole 23. The restricting plate 32 is fixed at one end of the inserting member 31 and inserted into the nail-hitting track 11, as shown in FIGS. 4-7. The nail clamp S has a first lateral side S1 and an opposite second lateral side S2 located in the restricting direction Y. Different sized nail clamp S have different distances between the first and second lateral sides S1, S2. The first lateral side S1 is abutted against a lateral surface of the nail-hitting track 11. The restricting plate 32 is located at the second lateral side S2 of the nail clamp S. When the movable member 31 moves in the restricting direction Y, the restricting plate 32 will be driven to move in the restricting direction Y within the nail-hitting track 11, and the restricting plate 32 can be moved to press against the second lateral side S2 of different sized nail clamps S, so as to clamp the nail clamp S between the lateral surface of the nail-hitting track 11 and the restricting plate 32, and the nail clamp S can be firmly held in the nail-hitting track 11 without slipping. The nail clamp S includes a clamping space S3 to clamp the wire C. The restricting plate 32 further includes a restricting portion 321 which is disposed in the concave 27 and movable in the restricting direction Y, as shown in FIGS. 4-7. The travel distance of the restricting portion 321 in the restricting direction Y is restricted by the restricting wall 271 of the concave 27, and the restricting portion 321 and the clamping wall 272 cooperate with each other to clamp the wire C in the restricting notch 28, so that the wire C can be fixed firmly during the firing of the nail gun, to ensure that the clamping space S3 of the fired nail clamp S can be aligned with the wire C to prevent damage to the wire C. Besides, the restricting portion 321 is movable in the restricting direction Y within the concave 27, so that different wires C of different diameters can be clamped.

The cover opening and closing member 50 includes a body 51 and a hook ring 52 pivotally coupled to the body 51. The hook ring 52 is used to hook the two hooks 13. The body 51 includes a pivoting portion 511 and a pulling portion 512 which are located at two ends of the cover opening and closing member 50, respectively. The pivoting portion 511 is pivotally coupled to the connecting portion 25 of the cover opening and closing member 20, as shown in FIG. 1. Hooking the hook ring 52 to the two hooks 13 and the pressing the pushing portion 512 can make the cover 20 firmly cover the nail-discharging member 10. To open the cover 20, as shown in FIG. 8, the pulling portion 512 can be pulled to disengage the hook ring 52 from the two hooks 13, so that the cover 20 is able to rotate with respect to the nail-discharging member 10 by pivoting about the pivoting end 21, and thus the cover 20 can be opened.

In the first preferred embodiment of the present invention, the movable member 31 is an inserting pin 311 with a gripping end 311A and a connecting end 311B. The restricting plate 32 is fixed to the connecting end 311B. At least two annular positioning grooves 311C are formed on the movable member 31 and located adjacent to the gripping end 311A. The cover 20 includes a positioning groove 24 which extends in the nail-hitting direction X and is in communication with the penetrating hole 23. A positioning assembly 40 includes a positioning ball 41, an elastic member 42 and a headless screw 43 which are sequentially disposed in the positioning groove 24, and the headless screw 43 is fixed in the positioning groove 24, in such a manner that the elastic member 42 has two ends pressed against the headless screw 43 and the positioning ball 41, respectively. With the elastic member 42, the positioning ball 41 is pushed through the penetrating hole 23 into the annular positioning grooves 311C of the movable member 31, so as to produce a positioning force to the movable member 31, so that the movable member 31 won't move in the restricting direction Y within the penetrating hole 23 when vibration or a small external force is exerted, and the restricting plate 32 can push the nail clamp S more stably. Preferably, when the movable member 31 is pulled or pushed to move along the restricting direction Y, the positioning ball 41 will move from one to another of the annular positioning grooves 311C, so that the restricting assembly 30 can be positioned at different positions along the restricting direction Y by the positioning assembly 40.

Figure 8:
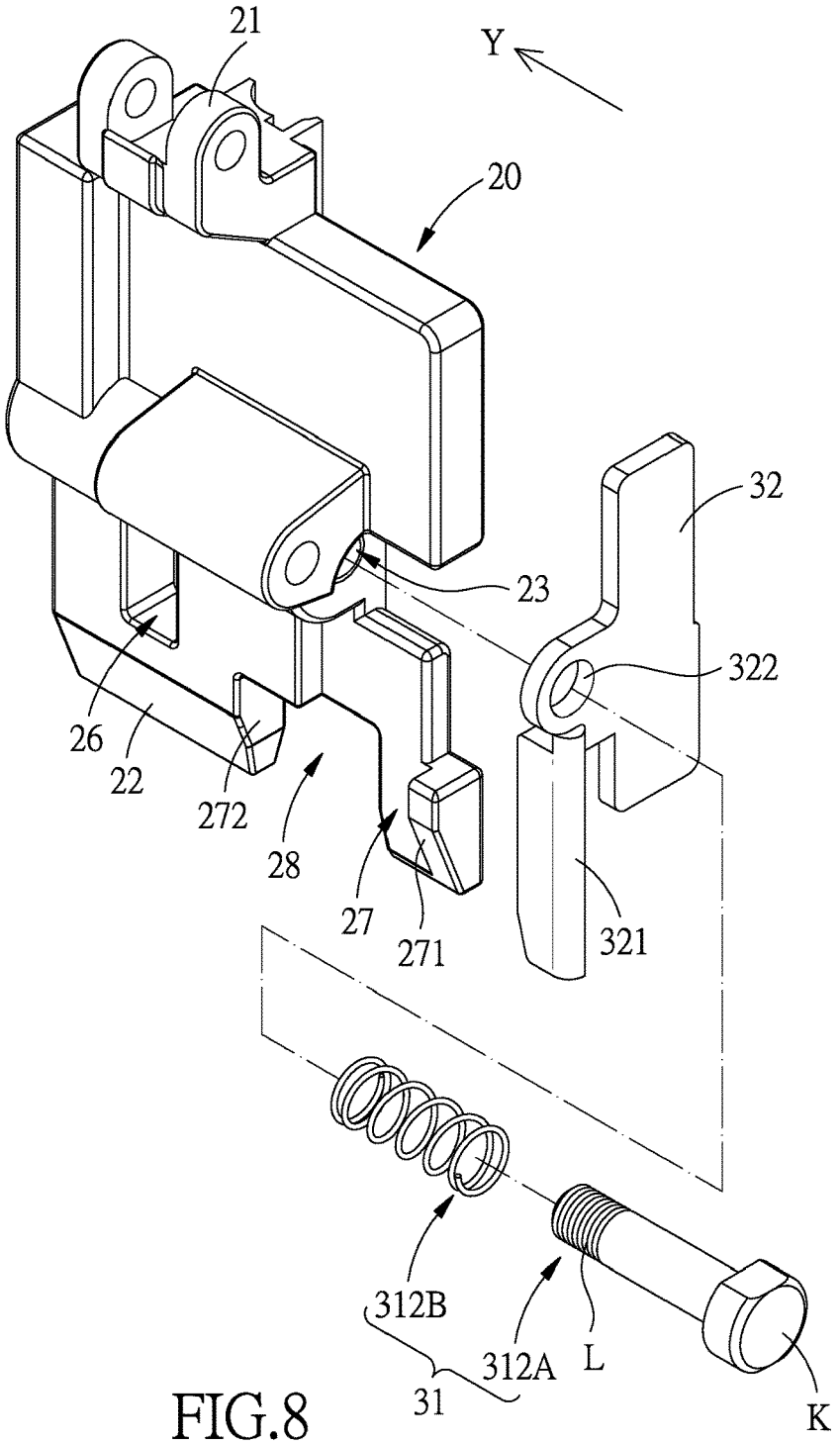
FIG. 8 is an exploded view of a muzzle suitable for holding nail clamps in accordance with a second preferred embodiment of the present invention.
Figure 9:
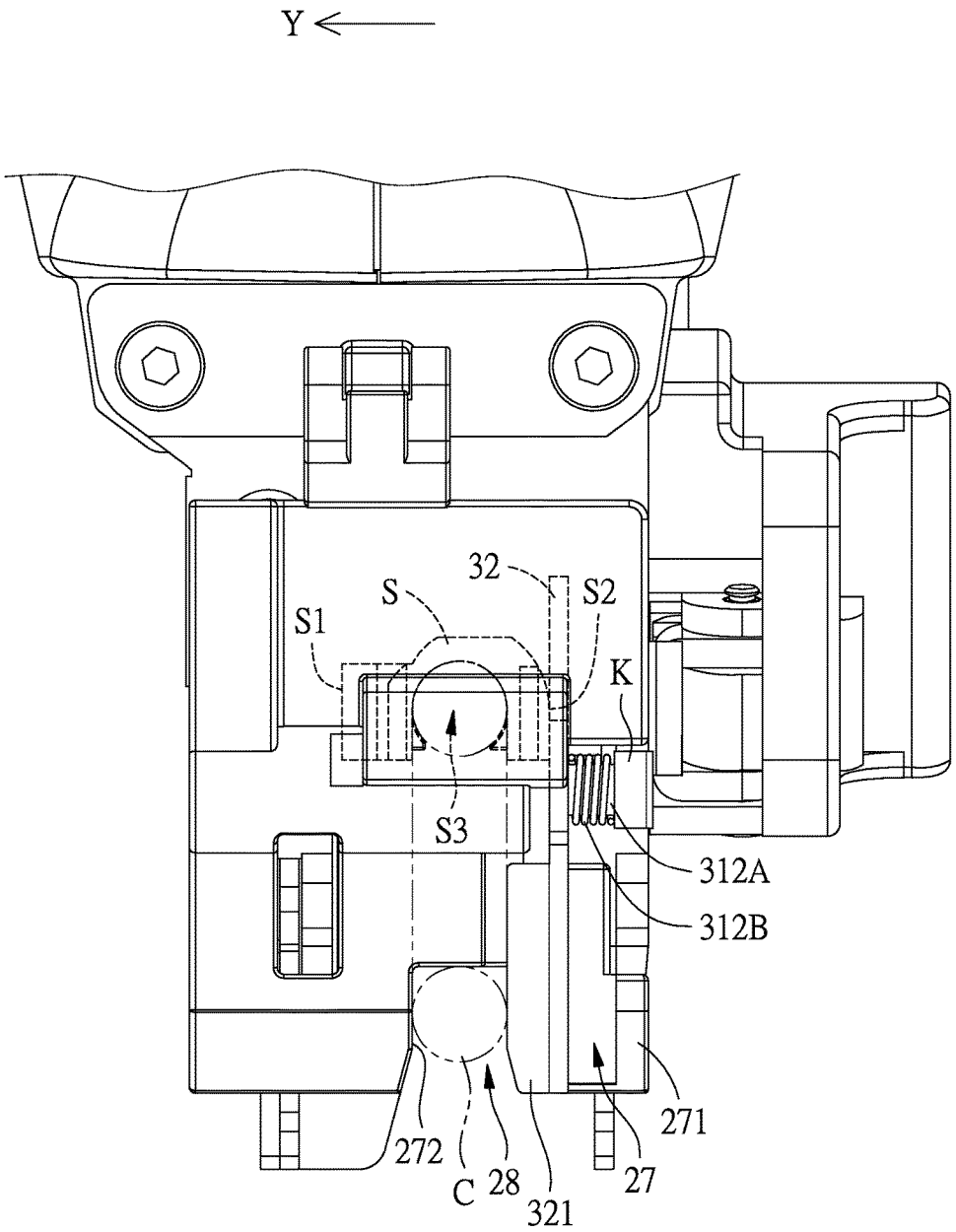
FIG. 9 is a front view of the muzzle suitable for holding nail clamps in accordance with the second preferred embodiment of the present invention.
Figure 10:
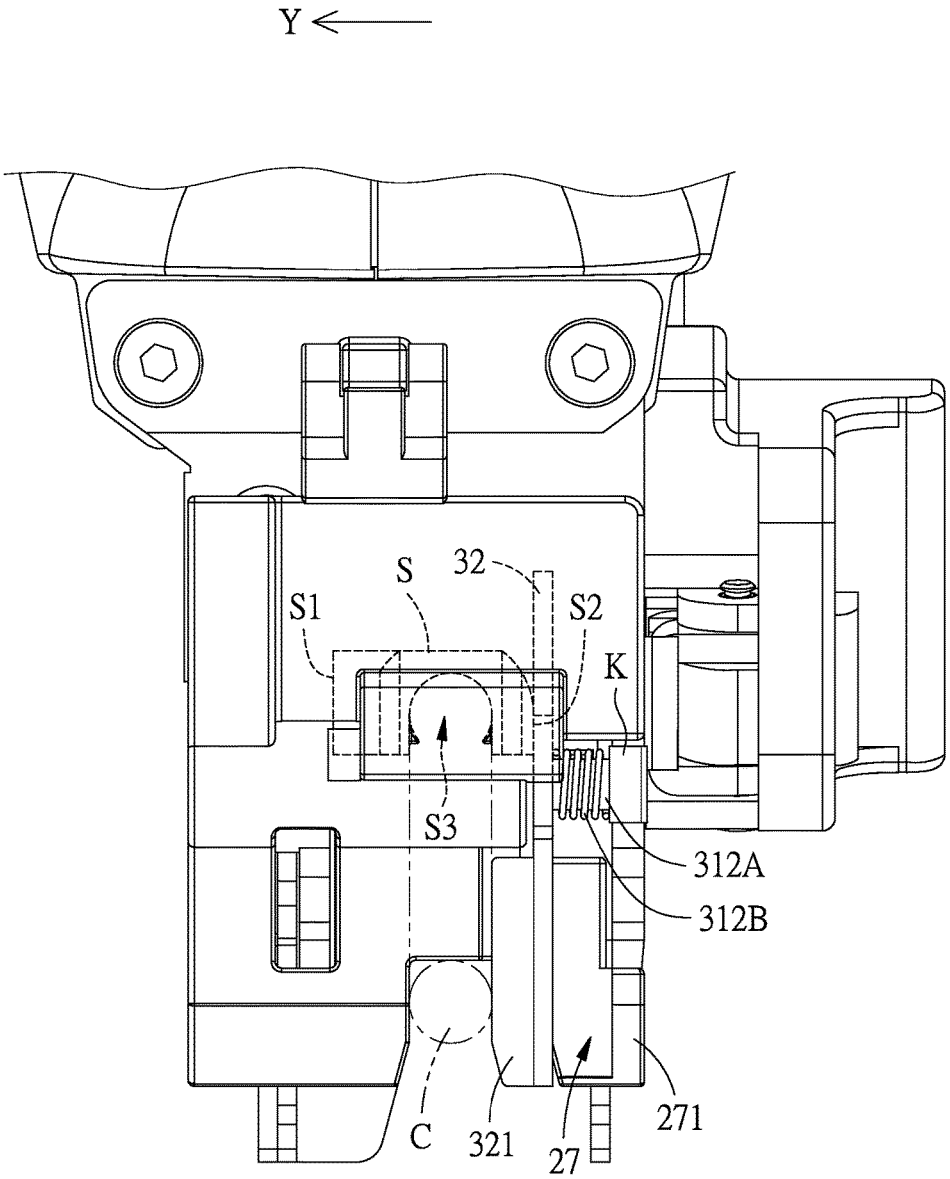
FIG. 10 is another front view of the muzzle suitable for holding nail clamps in accordance with the second preferred embodiment of the present invention.
Figure 11:
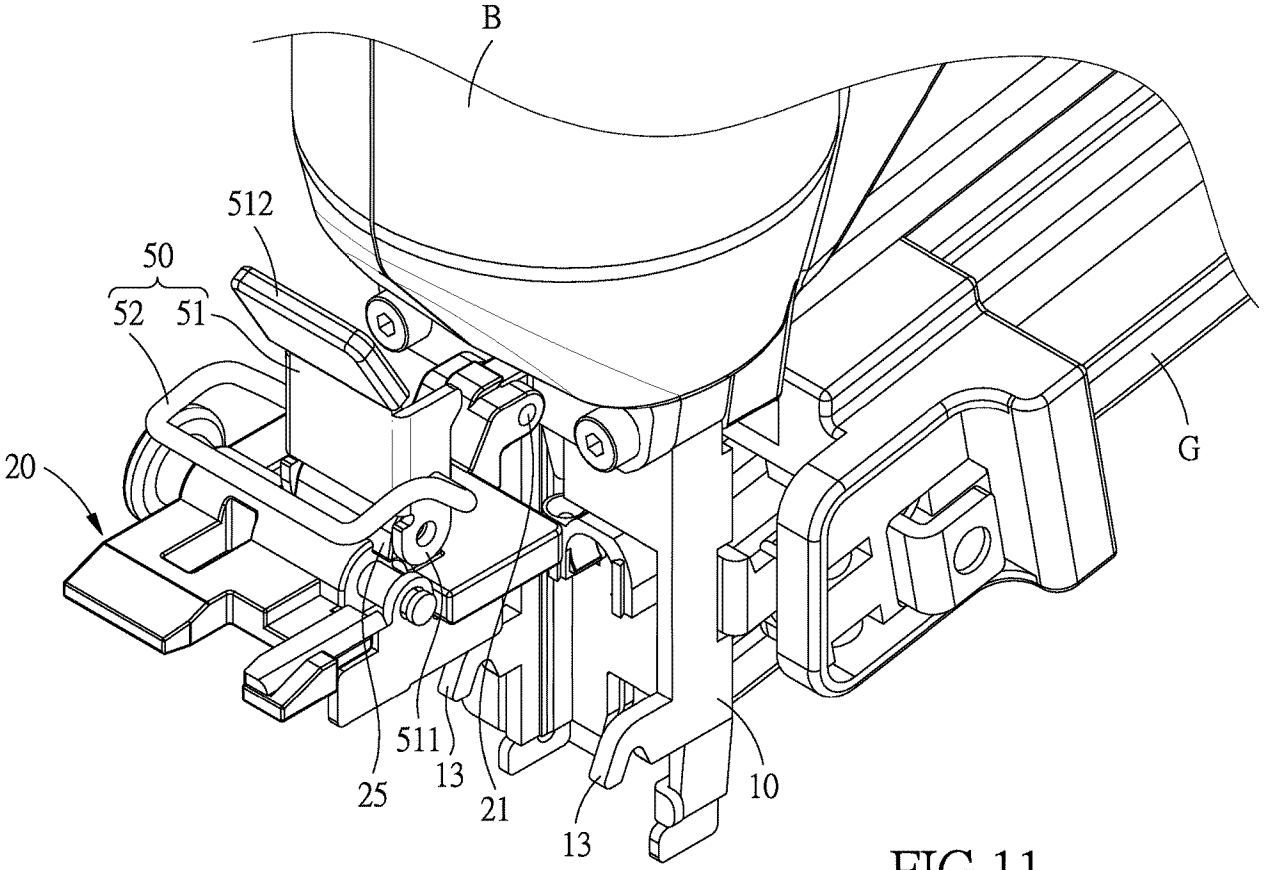
FIG. 11 is another perspective view of the muzzle suitable for holding nail clamps in accordance with the second preferred embodiment of the present invention.

In a second preferred embodiment of the present invention, as shown in FIGS. 8-10, the movable member 31 includes a screw 312A and an elastic member 312B. The restricting plate 32 includes an aperture 322. The screw 312A has a screw head K formed at one end thereof and a threaded shaft L at another. The elastic member 312B is sleeved onto the screw 312A, the threaded shaft L is inserted through the aperture 322 and screwed into the penetrating hole 23, and the elastic member 312B is compressed between the screw head K and the restricting plate 32 to push the restricting plate 32 toward the penetrating hole 23. Therefore, the restricting plate 32 can be moved to press against the second lateral side S2 of different sized nail clamps S, so as to clamp the nail clamp S between the lateral surface of the nail-hitting track 11 and the restricting plate 32, and the nail clamp S can be firmly held in the nail-hitting track 11 without slipping.

The muzzle A of the present invention essentially includes the restricting plate 32 and the movable member 31. The movable member 31 is coupled to the cover 20 and movable in the restricting direction Y. The restricting plate 32 is inserted in the nail-hitting track 11 and movable in the restricting direction Y. Therefore, the restricting plate 32 can be moved to press against the second lateral side S2 of different sized nail clamps S to clamp the nail clamp S between the lateral surface of the nail-hitting track 11 and the restricting plate 32, and the nail clamp S can be firmly positioned in the nail-hitting track 11 without slipping. Preferably, when the movable member 31 is pulled or pushed to move along the restricting direction Y, the positioning ball 41 will move from one to another of the annular positioning grooves 311C, so that the restricting assembly 30 can be positioned at different positions along the restricting direction Y by the positioning assembly 40.

While we have shown and described various embodiments in accordance with the present invention, it is clear to those skilled in the art that further embodiments may be made without departing from the scope of the present invention.

What is claimed is:

1. A muzzle suitable for holding nail clamps being coupled to a magazine and a nail gun body, the muzzle being disposed at a nail discharging end of the magazine, the magazine including a chamber for holding the nail clamps, the nail gun body having a piston inserted into the muzzle, the muzzle comprising: a nail-discharging member coupled to the nail discharging end of the magazine, and including a nail-hitting track and a nail-feeding hole which are in communication with each other, the nail-feeding hole being formed to conform to a shape of the nail clamp, and located corresponding to the nail discharging end of the magazine, and in communication with the chamber, the nail clamps in the chamber moving into the nail-hitting track through the nail-feeding hole, the nail-hitting track having a piston hole and a nail-discharging passage at opposite ends thereof, the piston hole being located toward the nail gun body, wherein the piston of the nail gun body is inserted into the nail-hitting track through the piston hole, the nail-discharging passage allows the nail clamps to move out of the nail-discharging member, the nail clamps are pushed through the nail-discharging passage when the piston inserts into the nail-hitting track to hit the nail clamps located in the nail-hitting track; a cover including a pivoting end and a movable end, a direction extending from the pivoting end to the movable end being defined as a nail-hitting direction, the pivoting end being pivotally connected to one end of the nail-discharging member where the piston hole is located, so that the cover is able to rotate with respect to the nail-discharging member by pivoting about the pivoting end, the cover including a penetrating hole which extends in a restricting direction; and a restricting assembly including an inserting member and a restricting plate which are coupled to each other, the inserting member extending in the restricting direction and being inserted into the penetrating hole, the restricting plate being inserted into the nail-hitting track, wherein each of the nail clamps has a first lateral side and an opposite second lateral side, the first lateral side is abutted against a lateral surface of the nail-hitting track, and the restricting plate presses against the second lateral side.

2. The muzzles claimed in claim 1, wherein the movable member includes a screw and an elastic member, the restricting plate includes an aperture, the screw has a screw head formed at one end thereof and a threaded shaft at another end, the elastic member is sleeved onto the screw, the threaded shaft is inserted through the aperture and screwed into the penetrating hole, and the elastic member is compressed between the screw head and the restricting plate.

3. The muzzles claimed in claim 1, wherein the nail-discharging member is formed with two spaced apart hooks, the cover has a hook hole and a connecting portion, the hook hole is provided for insertion of the hooks, a cover opening and closing member includes a body and a hook ring, the hook ring is pivotally coupled to the body, the body includes a pivoting portion and a pulling portion, the pivoting portion is pivotally coupled to a connecting portion of the cover opening and closing member, and the two hooks are hooked to the hook ring.

4. The muzzles claimed in claim 1, wherein a restricting notch is formed at the movable end of the cover to hold a wire, a concave is formed on the a surface of the cover where the connecting portion is located and is in communication with the restricting notch, the concave includes a clamping wall, the restricting plate further includes a restricting portion which is disposed in the concave and movable in the restricting direction, and the restricting portion and the clamping wall cooperate with each other to clamp the wire in the restricting notch.

5. The muzzles claimed in claim 4, wherein the concave further includes a restricting wall opposite to the clamping wall, a travel distance of the restricting portion in the restricting direction is restricted by the restricting wall of the concave.

* * * * *